US005729868A

United States Patent [19]

Liedgens et al.

[11] Patent Number: 5,729,868

[45] Date of Patent: Mar. 24, 1998

[54] CAN STORAGE DEVICE FOR RECTANGULAR CANS AT A CAN FILLING STATION

[75] Inventors: Hans-Peter Liedgens; Thomas Hendle, both of Mönchengladbach, Germany

[73] Assignee: W. Schlafhorst AG & Co., Moenchengladbach, Germany

[21] Appl. No.: 679,011

[22] Filed: Jul. 12, 1996

[30] Foreign Application Priority Data

Jul. 14, 1995 [DE] Germany ..... 195 25 737.5

[51] Int. Cl.[6] ..... D01H 9/18; B65H 54/80

[52] U.S. Cl. ..... 19/159 A

[58] Field of Search ..... 19/159 A; 57/90

[56] References Cited

U.S. PATENT DOCUMENTS

| | | | |
|---|---|---|---|
| 4,102,893 | 7/1978 | Weber | 19/159 A |
| 5,276,947 | 1/1994 | Fritschi et al. | 19/159 A |
| 5,311,645 | 5/1994 | Schwalm et al. . | |
| 5,471,711 | 12/1995 | Koyacs et al. | 19/159 A |

FOREIGN PATENT DOCUMENTS

| | | |
|---|---|---|
| 40 18 088 A1 | 1/1991 | Germany . |
| 40 15 938 A1 | 11/1991 | Germany . |
| 41 30 463 A1 | 3/1993 | Germany . |
| 42 33 357 A1 | 4/1994 | Germany . |
| 43 23 726 A1 | 1/1995 | Germany . |
| 94 21 084 U1 | 6/1995 | Germany . |
| WO 91/18135 | 5/1991 | WIPO . |

*Primary Examiner*—Ismael Izaguirre
*Attorney, Agent, or Firm*—Kennedy Covington Lobdell & Hickman, LLP

[57] ABSTRACT

In the automatic transport of rectangular spinning cans between a can filling station and the work stations of textile machines which process sliver, it is known to arrange a can storage device in association with the can filling station, with a section of the can storage device for receiving empty cans from a traveling can transport vehicle and a section for storing and transferring full cans to the can transport vehicle, and with the can filling station between these two sections. The present invention contemplates the ordered and positionally exact transfer of the cans to and from the can transport vehicle by transferring of empty cans from the can transport vehicle to the empty can storage section such that the transferred empty cans immediately follow the empty cans already stored thereat. In the transfer of full cans to the can transport vehicle, a leading one of the full cans to be transferred is transferred into a corresponding leading one of the occupyable parking spaces on the can transport vehicle. Following a can transfer operation, the arrangement of the empty and full cans remaining in the can storage device is moved so as to leave a transfer space at the filling station unoccupied.

8 Claims, 15 Drawing Sheets

CAN STORAGE DEVICE FOR RECTANGULAR CANS AT A CAN FILLING STATION

FIELD OF THE INVENTION

The present invention relates to a method for exchanging rectangular sliver cans between a can transport vehicle and a can storage device disposed at a can filling station for filling cans with slivers which has an area for receiving and storing empty cans and an area for storing full cans by means of a can transport vehicle, and wherein empty cans are brought to the filling station between the two areas and after being filled with sliver are returned and placed in the area for storing full cans.

BACKGROUND OF THE INVENTION

Many suggestions have already been made for automating the transport of sliver cans from the can filling stations of a sliver producing machine to the textile machines which process the sliver. Driverless can transport vehicles have been suggested, particularly for supplying the work stations of the textile machines which process the sliver, and are known, for example, from German Patent Publication DE 43 23 726 A1. These vehicles are able to automatically deliver empty cans to the can filling stations, to pick up full cans freshly filled with sliver, to transport them to the textile machines and to set them down at the work stations of the machines which require sliver after an empty sliver can which had previously been standing in an empty storage space has been picked up. Such a can transport vehicle relieves the machine operator of heavy manual labor.

The can transport vehicle known from the above-mentioned publication transports so-called rectangular cans which are sufficiently narrow that they can be placed under a respective work station of a textile machine processing the sliver, for example an open end spinning machine, and only take up the appropriate space of the work station which is assigned to them. Rectangular cans with these dimensions considerably simplify the supply of the work stations of the textile machines processing the sliver.

In the same way in which the exchange of empty cans for filled cans is possible without problems at the textile machines, the exchange of empty cans for full cans must also take place reliably and without interruption at the filling stations.

So-called can storage devices are known for making a smooth can change possible at the can filling stations, namely the transfer of empty cans from the can transport vehicle to the can filling station and the placement of filled cans from the can filling station onto the can transport vehicle. The storage devices which are located upstream of the filling station offer the opportunity of unloading empty sliver cans from a can transport vehicle while an empty can is being filled with sliver and subsequently loading the can transport vehicle with ready, sliver-filled cans.

Exemplary embodiments of can storage devices at can filling stations are known from International Patent Publication WO 91/18135. Once a can transport vehicle has been positioned at such a storage device, the empty cans are unloaded and the full cans are loaded successively at a single position of the can transport vehicle. One respective empty can is replaced by one full can, which takes up time. In accordance with a representative embodiment, the unloaded cans are moved on a belt to a transfer point, from there into the can filling station by means of a perpendicularly extending chain with carriers, from there back to the transfer point, and from there are moved away by means of a further belt. Thus, it is not clear how the full cans waiting in the storage device may be exactly associated with parking places on the can transport vehicle. Since the occupancy of the storage spaces in the storage device is not monitored, a can exchange on a can transport vehicle is only possible if, in the empty can storage area the same number of empty spaces behind the already moved empty cans lies opposite the parking places on the can transport vehicle, which docks in a predetermined position. In the area of the full cans, the full cans to be exchanged must be located opposite the parking places on the can transport vehicle in the loading position.

OBJECT AND SUMMARY OF THE INVENTION

It is accordingly an object of the present invention to provide an improved method for the exchange of empty sliver cans for full cans at a loading station for a can transport vehicle.

This object is attained by means of the novel method and apparatus of the present invention for exchanging rectangular sliver cans between a can transport vehicle and a can storage device disposed at a can filling station for filling cans with slivers, wherein the can transport vehicle has a plurality of aligned can parking spaces, the can storage device has a section for storing empty cans in a plurality of aligned empty can spaces and a section for storing full cans in a plurality of aligned full can spaces, and the filling station is disposed between the empty can storage section and the full can storage section. Briefly summarized, under the present invention, the can transport vehicle is positioned by appropriate means at the empty can storage section of the can storage device, empty cans are transferred to the empty can storage section from the can transport vehicle, the empty cans from the empty can storage section are moved to the filling station to be filled with sliver, the filled cans are moved from the filling station to the full can storage section, the can transport vehicle is positioned at the full can storage section of the can storage device, and full cans from the full can storage section are transferred to the can transport vehicle positioned at the can storage device.

In accordance with the invention, the transferring of empty cans to the empty can storage section is basically accomplished by determining the arrangement of empty cans already stored in the empty can spaces of the empty can storage section and moving such arrangement of empty cans by a sufficient number of empty can spaces that the empty can spaces located opposite the parking spaces having empty cans on the can transport vehicle to be transferred are unoccupied, and subsequent to the transferring of empty cans to the empty can storage section, moving the already-stored arrangement of empty cans and the empty cans transferred from the can transport vehicle to occupy the empty can spaces of the empty can storage section most closely adjacent the filling station.

The transferring of full cans from the full can storage section is accomplished by determining the arrangement of full cans already stored in the full can spaces of the full can storage section and moving such arrangement of full cans by a sufficient number of full can spaces that a forwardmost one of the full can spaces occupied by a full can is located opposite a forwardmost occupyable can space on the can transport vehicle, and subsequent to the transferring of full cans to the can transport vehicle, moving any full cans remaining at the full can storage section to occupy the full can spaces most closely adjacent the filling station.

In a preferred embodiment, the empty cans and the filled cans are moved as indicated by respective moving means which include can carrier elements spaced from one another by a distance of one can width. Another can moving means with spaced can carrier elements for supporting a single can is provided at the transfer space to the filling station, and means are provided for selectively coupling the can moving means at the transfer space alternatingly or mutually with the means for moving empty cans and with the means for moving filled cans. The means for moving empty cans preferably includes a controllable drive means for selectively displacing the empty can storage section by a predeterminable distance and the means for moving filled cans likewise has an independent controllable drive means for selectively displacing the full can storage section by a predeterminable distance.

Equipping the respective can moving means in the empty can storage section and in the full can storage section of the can storage device with carriers allows the positionally correct placement of the cans onto and removal from these moving means. The carriers make it possible for all cans standing on the moving means, and therefore in the storage device, to take up identical positions in respect to each other. The further moving means provided at the transfer point to the filling station between the full can storage section and the empty can storage section is exactly dimensioned to conform to the width of a can and has two couplings to permit coupling alternatingly or together with the moving means of the full can storage section and with the moving means of the empty can storage section. Since both the moving means in the full can storage section and the moving means in the empty can storage section have individual drive means, the can moving means in the area of the transfer location can be coupled with the can moving means of the empty can storage section during the receipt of an empty can and with the can moving means of the full can storage section during the transfer of a full can.

If an empty can is filled at the filling station, the can space defined at the transfer location is empty. Since the can transport vehicle at the can storage device has a fixed position in the empty can storage section and a fixed position in the full can storage section, it is necessary in the course of transferring empty cans to the empty can storage section to displace the cans in the can storage device by a predeterminable distance such that the empty cans can be simultaneously transferred from the can transport vehicle in one work step into the empty can storage section. In the process, the cans in the empty can storage section, at the transfer point and in the full can storage section are displaced by the respective can moving means such that the empty cans removed from the can transport vehicle immediately follow the empty cans which are already on the storage device in the empty can storage section. For the purpose of transferring empty cans by means of the can transport vehicle positioned at the can storage area to the empty can storage section, the defined arrangement of cans already standing in the can storage device is displaced transversely to the transfer direction sufficiently until empty storage spaces are located opposite all empty cans to be transferred. If the empty cans to be transferred from the can transport vehicle follow the last empty can standing in the empty can storage section, storage spaces are advantageously saved and the outlay for technical control devices for eliminating the gaps is unnecessary.

During the transfer operation, the empty space normally at the transfer location is maintained between the stored empty cans and the stored full cans and, after the empty cans have been transferred, the respective can moving means are operated to return this empty can space back into its original position at the transfer location. For this purpose, the cans which were already present prior to the transfer operation must again take up their original places. In this manner, the transfer of an empty can to the filling station at the transfer point and the subsequent placement of the same can in the same place in the sequence of cans is possible. Since the occupation of the individual storage spaces of the can storage device is monitored by means of sensors, the displacement of an empty space can advantageously be identified easily. The moving means are moved in reverse by the number of the displaced storage spaces, so that the empty space previously present at the transfer location returns again to its initial position at the transfer location.

So that the number of full cans which the can transport vehicle can receive for one trip can be taken up in one work step without gaps in the alignment of cans of the respective storage areas being created, the alignment of full cans present in the full can storage section is displaced transversely to the can transfer direction such that, as viewed in the direction of travel of the can transport vehicle, the first full can standing in the can storage device is located opposite the first parking space of the vehicle available to be occupied. Thus, the displacement of the cans takes place over a predeterminable distance which is comprised of the defined number of can spaces which are displaced.

A can transport vehicle can unload empty cans in the empty can storage section only if the number of the still empty storage spaces corresponds to the number of empty cans to be delivered. The can transport vehicle leaves the full can storage section only when the can parking places on the can transport vehicle intended for the transport of full cans are occupied by full cans.

The advantages of the invention become apparent in particular when the empty can storage section as well as the full can storage section have more storage spaces than the can transport vehicle. Thus, the can transport vehicle can always discharge empty cans and take on full cans independently of the occupancy of the storage sections of the storage device. If required, empty cans temporarily move into the full can storage section and full cans into the empty can storage section in the process.

The invention will be explained in more detail by means of an exemplary embodiment as well as by means of can changing situations at the can storage device.

DETAILED DESCRIPTION OF THE PREFERRED EMBODIMENTS

Figure 1:
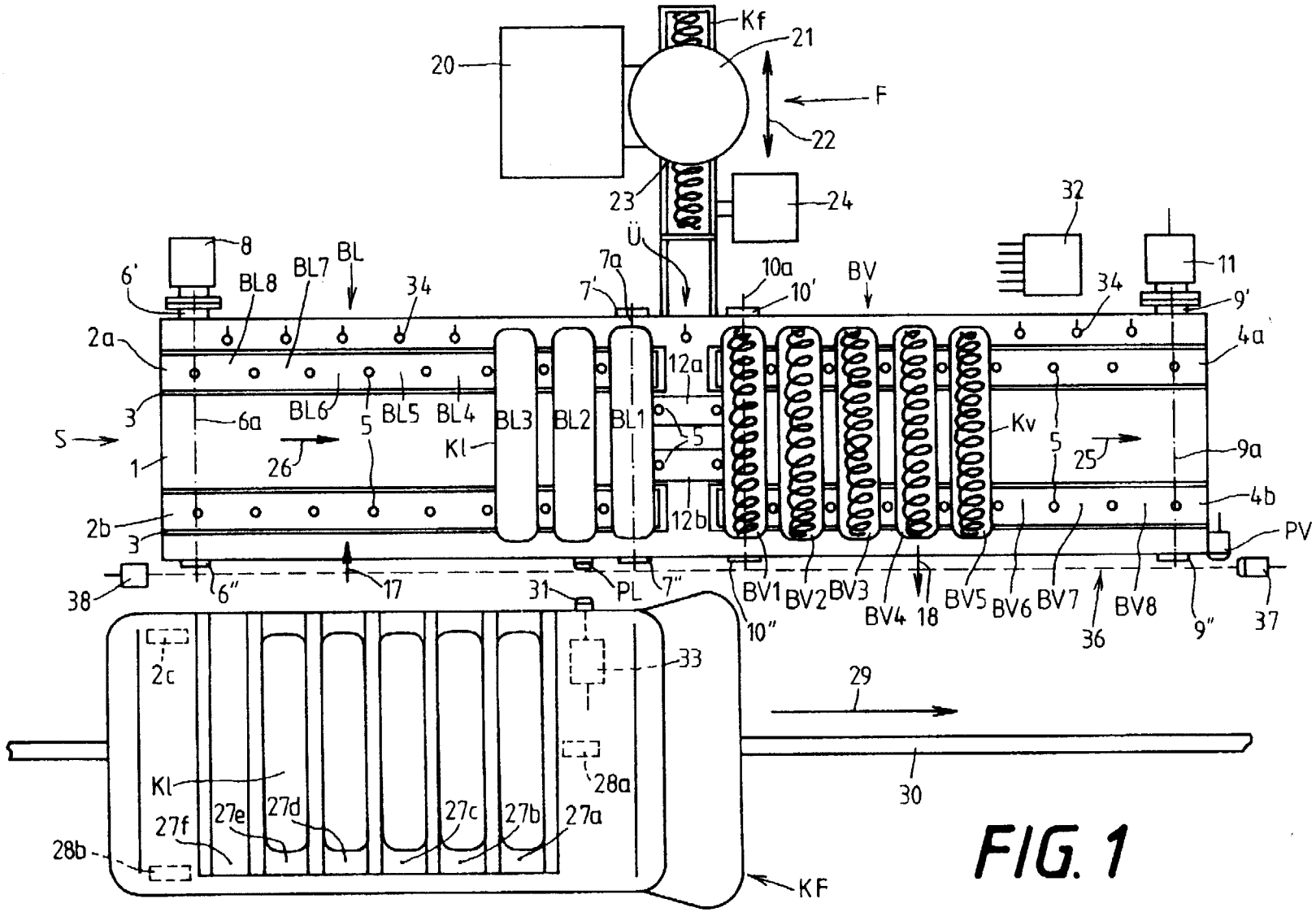
FIG. 1 is a view of the can storage device at a filling station with a can transport vehicle positioned in front of the empty can storage section.

Referring now to the accompanying drawings and initially to FIG. 1, a can storage device S is schematically shown wherein stored sliver cans stand on a flat continuous sheet metal plate 1 which rests on a frame (not shown). The can storage device S is divided into a section or area for storing empty cans BL and a section or area for storing full cans BV, separated from one another by a can transfer location Ü. Empty cans are moved from this transfer location Ü to a can filling station F to be loaded with sliver, after which the filled cans are again pushed back onto the can storage device S at the transfer location Ü.

A pair of parallel belts extend in the longitudinal direction of the storage device S along both the empty can storage section BL and the full can storage section BV to serve as the means for transporting the cans in the respective sections. More specifically, two belts 2a and 2b are disposed parallel with each other in the empty can storage section BL within recesses or indentations 3 in the sheet metal plate 2 such that their upper belt surfaces lie below the level of the sheet metal plate 1. Similarly, two belts 4a and 4b also extend parallel in respect to each other in the full can storage section BV in symmetrical relation to the belts in the empty can storage section BL. Thus, the belts 4a and 4b and the belts 2a or 2b are respectively disposed in alignment with one another.

Each of the belts 2a, 2b, 4a, 4b are respectively equipped with can carrier devices or elements 5 spaced along the belts at a distance equal to the width of a sliver can K. For example, these carriers can be upstanding pins or plates standing on their short edges, which make it possible to displace the cans on the sheet metal plate 1 during the synchronous movement of the belts. The carriers 5 respectively define the boundaries of individual can storage spaces BL1 to BLn or BV1 to BVn in the respective storage sections BL and BV. Instead of the sheet metal plate 1, it is also possible to provide elongate bars to extend rightwardly and leftwardly in parallel with the belts for supporting the cans.

The belts 2a and 2b are trained around coaxially arranged reversible drive rollers 6', 6" and 7', 7" with the drive rollers 6' and 6" being driven by a motor 8. The belts 4a and 4b similarly are trained about the reversible drive rollers 9', 9", 10' and 10", with the drive rollers 9' and 9" being driven by a motor 11.

Figure 2:
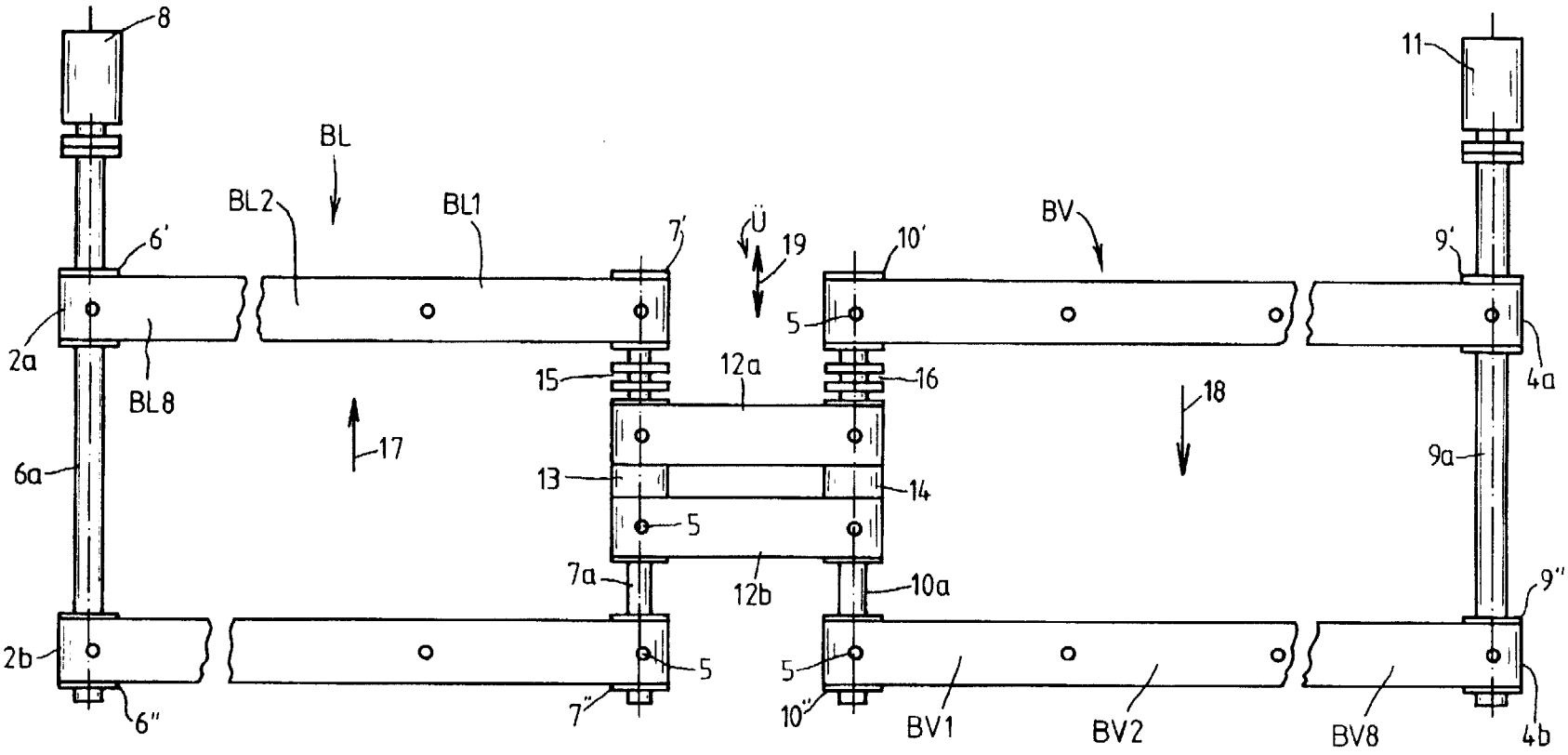
FIG. 2 shows the arrangement of the transport means of the can storage device in a top view.

Two parallel belts 12a and 12b extend across the area of the transfer location Ü intermediate the belts 2a, 2b, 4a and 4b, and are dimensioned in length to be exactly the width of the transfer location Ü, which in turn is the width of a sliver can. The belts 12a and 12b are also equipped with carrier elements 5 which are likewise spaced apart from each other by the width of a can. The belts 12a and 12b extend around two supporting rollers 13 and 14, which are rotatably seated coaxially on the shafts 7a, 10a, respectively, independently of the reversing rollers 7', 7" and 10', 10". In this manner, the belts 12a and 12b can be selectively coupled either with the belts 2a and 2b or with the belts 4a and 4b by the provision of respective switchable couplings 15, 16 disposed between the supporting rollers 13, 14 and the respective shafts 7a, 10a (see FIG. 2). Thus, if the belts 12a and 12b are intended to run together with the belts 2a and 2b, the coupling 15 between the supporting roller 13 and the shaft 7a is engaged. If the belts 12a and 12b are intended to run together with the belts 4a and 4b, the coupling 16 between the supporting roller 14 and the shaft 10a is engaged. The carriers 5 are arranged on the belts 12a and 12b such that they are respectively located in alignment with the positions of the carriers 5 on the belts 2a, 2b, 4a and 4b. Thus, if a can is standing at the transfer location Ü, the carriers 5 of the belts 2a and 2b rest against the one side and the carriers 5 of the belts 4a and 4b against the other side, while at the same time the carriers 5 of the belts 12a and 12b enclose the can standing on them. During the respective coupling of the belts 12a and 12b to either the belts 2a and 2b or the belts 4a and 4b, the respective carriers run synchronously.

Figure 3:
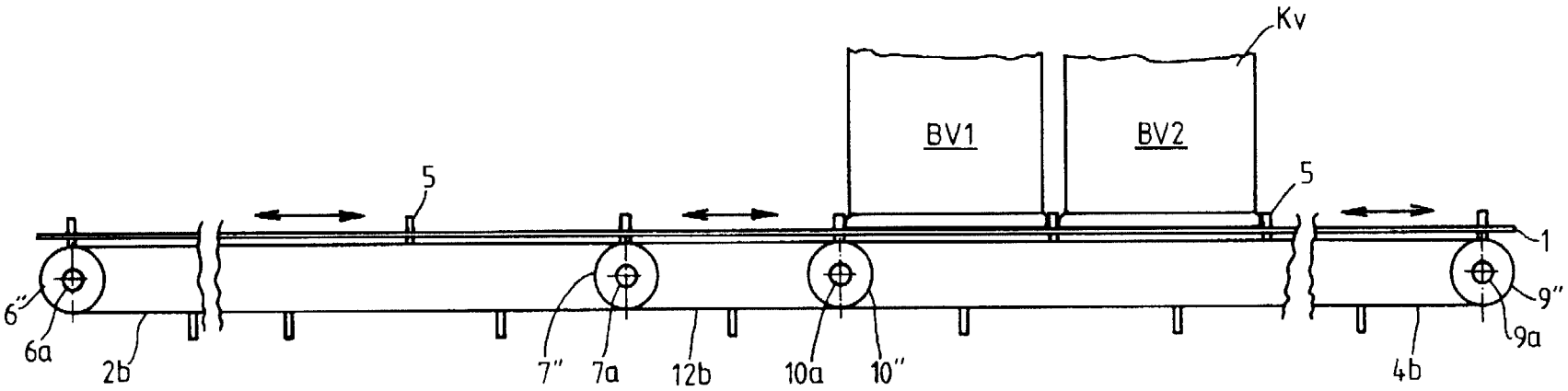
FIG. 3 shows the arrangement of the transport means of the can storage device in a front view.

FIG. 3 shows the arrangement of the transport means of the can storage device in a front view. Two full sliver cans Kv are depicted upstanding on the sheet metal plate 1 in the full can storage section BV, with the carriers 5 bordering the respective can storage locations BV1 and BV2. The belts 2a, 2b, as well as 4a and 4b and the belts 12a and 12b, lie in a common plane, either in a depression in the sheet metal plate 1 or within slits formed in the sheet metal plate 1 through which the carriers 5 project to engage and transport the cans. In place of continuous endless belts, it is also possible to utilize chains. The belts must be disposed in respect to the bottom sheet metal plate i such that, when the cans are displaced transversely to their lengthwise dimension, they do not interfere with the transfer location Ü and are not damaged. When transferring empty cans into the empty can storage section BL in the direction of the arrow 17, or when transferring full cans from the full can storage section BV in the direction of the arrow 18, the belts also must not hamper the displacement of the cans. The same requirements apply to the arrangement of the belts 12a and 12b in the area of the transfer location Ü, where the transfer of empty cans Kl to the filling station F and the transfer of filled cans Kv from the filling station F takes place in the direction indicated by the two-headed arrow 19.

As can be seen in FIG. 1, the can storage device S has a total of 16 storage spaces, which are arranged symmetrically at each side of the can parking space defined by the transfer location Ü, the empty can storage section BL comprising eight storage spaces and the full can storage section BV also comprising eight storage spaces. In the circumstance illustrated in FIG. 1, three empty cans Kl are standing in the empty can storage section BL while five full cans Kv are standing in the full can storage section BV. Another can Kf is standing in the filling position at the filling station F on a section 20 having a filling head 21 suitable for filling rectangular cans with sliver in coordination with a device 23 which is suitable for executing a reciprocating movement 22 of the can. For example, the device 23 can be a carriage which is adapted to perform the reciprocating movement by a further mechanism 24 which also moves an empty can from the transfer location Ü to the filling station F and back into the transfer location Ü when the can is filled. Alternatively, a manipulating device may be provided by which the empty cans can be pulled or pushed out of the transfer location Ü and under the filling head 21, for example by means of a gripper device, and then the filled can returned to the transfer location by means of the same manipulating device. A testing station (not shown) can be installed between the transfer location Ü of the can storage device S and the filling station F for detecting sliver remnants in the empty cans moving to the filling station and for detecting possible damage of the empty cans and the testing station may be equipped to perform the emptying of sliver remnants from the cans if required. The transfer location can also be equipped in accordance with German Patent Publication DE 41 30 463 A1, which discloses the removal of empty cans from an endless belt to a filling station and the return of the filled cans to the endless transport belt.

When a can has been filled at the filling station F and has been transferred to the transfer location Ü, the coupling 16 is engaged to connect the belts 12*a* and 12*b* with the belts 4*a* and 4*b*, whereupon the motor 11 is actuated to cause the belts to move in unison rightwardly in the direction of the arrow 25 in FIG. 1 by exactly one can width. In the process, the freshly filled can is pulled into the full can storage section BV, and the transfer location is freed for transfer of another empty can Kl from the empty can storage section BL. The coupling 16 may then be disengaged and the coupling 15 may be engaged to couple the belts 12*a* and 12*b* with the belts 2*a* and 2*b* for transferring another empty can Kl from the empty can storage section BL to the transfer location Ü. Upon actuation of the motor 8, the coupled belts are displaced in unison rightwardly by one can width in the direction of the arrow 26 in FIG. 1. As a result, the empty can Kl which was previously adjacent the transfer location Ü moves into the transfer location Ü and is moved out of the transfer location Ü and under the filling head 21 of the section 20 by means of the device 24.

As can be further seen from FIG. 1, a can transport vehicle KF has been positioned in front of the empty can storage section BL of the storage device S. The can transport vehicle KF has six parking spaces 27*a* to 27*f* for cans. By way of example, in the instant circumstance illustrated, the can transport vehicle KF supports five empty cans Kl in the spaces 27*a* to 27*e*, with the space 27*f* empty. The can transport vehicle KF is supported on three wheels 28*a* to 28*c* as indicated in broken lines, of which the forward wheel 28*a* can be driven and steered. The can transport vehicle moves only in the indicated direction 29 under the guidance of an induction track 30, for example.

The can transport vehicle KF can be positioned at two locations alongside the can storage device S, namely, at the empty can storage section BL and at the full can storage section BV. Positioning takes place by means of sensors appropriately placed on the can transport vehicle KF and on the can storage device S. More specifically, a sensor 31 is disposed at the front end of the can transport vehicle KF on the side thereof facing the can storage device S and forwardly of the parking spaces 27*a*–27*f* for the cans, as viewed in the direction of travel of the can transport vehicle KF. A compatible sensor PL is disposed on the can storage device S at the empty can storage section BL, and another like sensor PV is disposed at the full can storage section BV. The sensors PL, PV and 31 are adapted to function not only for position determination of the can transport vehicle KF, but are also designed for the wireless electronic exchange of data bidirectionally between the can transport vehicle KF and a central control device 32 of the can storage device S.

The can transport vehicle KF with its load of empty cans Kl moves along the induction track 30 in the direction of travel 29 until the sensors PL and 31 are located directly opposite each other. In this position, the can transport vehicle KF is correctly positioned in front of the empty can storage section BL for the transferral of the empty cans Kl thereto. The transfer of the empty cans to the can storage device is initiated by means of a bidirectional exchange of data between a control device 33 of the can transport vehicle KF and the control device 32 of the can storage device S. For this purpose, it is first necessary to determine which can storage spaces in the empty can storage area BL are occupied, which is determined by means of sensors 34 associated with the individual spaces. As illustrated in FIG. 1, of the eight storage spaces BL1 to BL8 of the empty can storage area BL, the three storage spaces BL1 to BL3 most closely adjacent to the transfer location Ü are occupied by empty cans Kl. Thus, in this circumstance, the can transport vehicle KF would not be capable of transferring the empty can Kl in the first parking space 27*a* to the occupied adjacent space of the empty can storage area BL of the can storage device S. Thus, in accordance with the present invention, it is provided under such circumstances for each of the cans already stored at the empty can storage area BL to be respectively displaced rightwardly (as viewed in FIG. 1) toward the transfer location Ü by a sufficient number of storage spaces (in this case, one storage space), so that the transfer of all empty cans Kl from the parking spaces 27*a* to 27*e* on the can transport vehicle KF can take place.

How the transfer of empty cans from the can transport vehicle KF to the empty can storage section BL of the can storage device S takes place and how subsequently the transfer of filled cans from the full can storage section BV to the can transport vehicle KF takes place will be explained in more detail by means of the schematic drawings of FIGS. 4–8.

Figure 4:
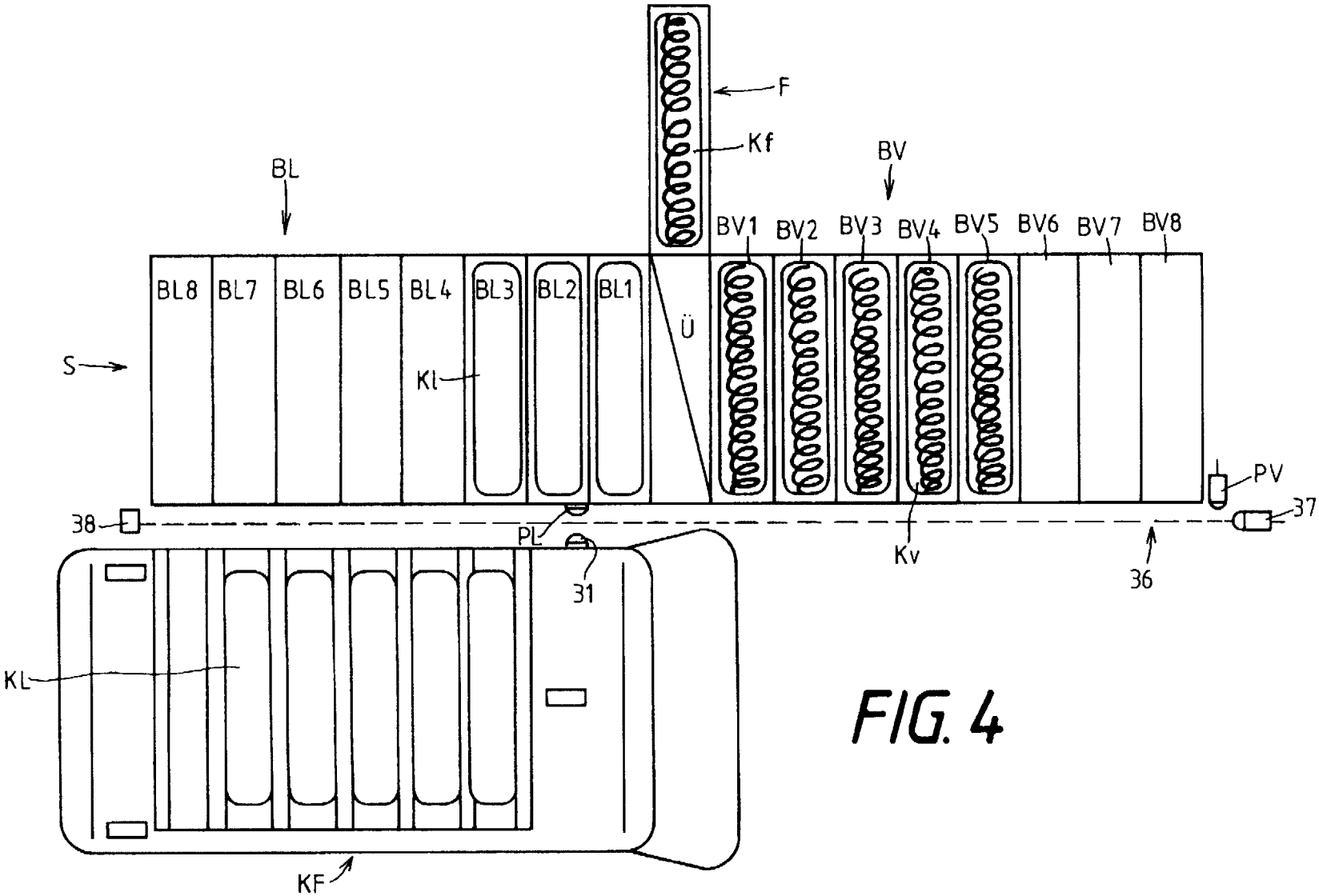
FIGS. 4 and 5 show the transfer of empty cans by a can transport vehicle to a partially filled storage empty can storage section.

The situation shown in FIG. 1 is again represented schematically in FIG. 4. Here, and in the further exemplary sequences of FIGS. 5–8, the representation of the details of the can storage device S and the can transport vehicle KF as well as the filling station F is omitted and, for sake of clarity and simplicity, only the configuration of the empty cans Kl and the full cans Kv in the can storage device S and the occupation of the can transport vehicle KF with cans to the extent required for understanding the invention are represented.

Figure 5:
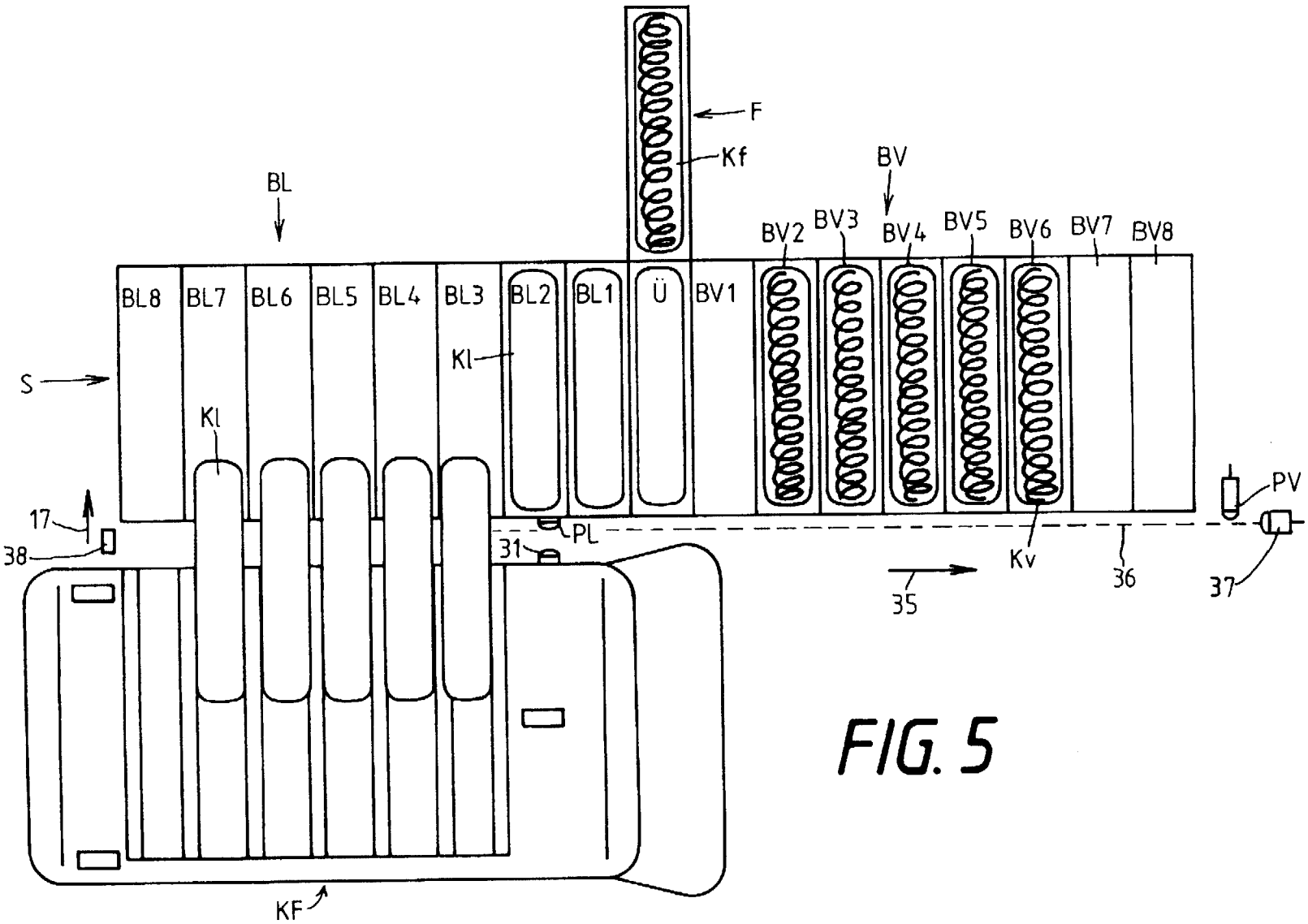

So that all empty cans Kl can be transferred from the can transport vehicle KF to the empty can storage section BL of the can storage device S, all of the cans stored by the can storage device S, including both the empty cans Kl in the empty can storage section BL and the full cans Kv in the full can storage section BV, are moved to the right in the direction of the arrow 35 by one storage space, as represented in FIG. 5. As a result, the storage space BL3 in the empty can storage section BL is freed for receiving the empty can Kl from the adjacent first parking space 27*a* of the can transport vehicle KF. For this purpose, the couplings 15 and 16 are engaged and each of the belts 2*a*, 2*b*, 12*a*, 12*b*, 4*a*, 4*b* are moved in unison by one can width by means of the motors 11 and 8.

In the instant exemplary circumstance of FIGS. 1 and 4, it was only necessary to move the belts by one storage space width. Since the can transport vehicle KF may only transfer its empty cans to the storage device S if the same number of storage spaces in the empty can storage section BL of the storage device S are free as the number of empty cans carried by the can transport vehicle, it will be understood to be necessary that the belts of the storage device S be moved by the same respective number of storage spaces of the storage device S as the number of cans on the parking spaces of the can transport vehicle which stand opposite the cans stored in the empty can storage section BL once the can transport vehicle has been positioned. Thus, the belts are moved by the number of storage spaces necessary until the sensors 34 no longer detect cans on the storage spaces BV1–BV8 which are opposite the occupied parking spaces of the can transport vehicle KF.

In FIG. 5 the transfer of all empty cans Kl of the can transport vehicle KF to the empty can storage section BL is in the process of taking place, as indicated by the arrow 17, and may be performed, for example, with the aid of devices disposed on the can transport vehicle such as are known from German Patent Publication DE 43 23 726 A1.

So that a correct transfer of the cans takes place and no can projects past the contour of the can storage device, a so-called gap control is utilized wherein a photoelectric barrier 36 is used to monitor and control the gap between the can transport vehicle KF and the can storage device S. Specifically, a light beam is directed from a light source 37 to a receiver 38 through the area between the can transport vehicle KF and the can storage device S which should be open and unobstructed if the can transfer was successfully completed. If the gap is indicated to be clear after the can exchange has been performed by the detection of the light beam by the receiver 38, the correct transfer of the cans has taken place and the can transport vehicle can now be moved into position at the full can storage section BV in order to take on therefrom a corresponding load of full cans.

Figure 6:
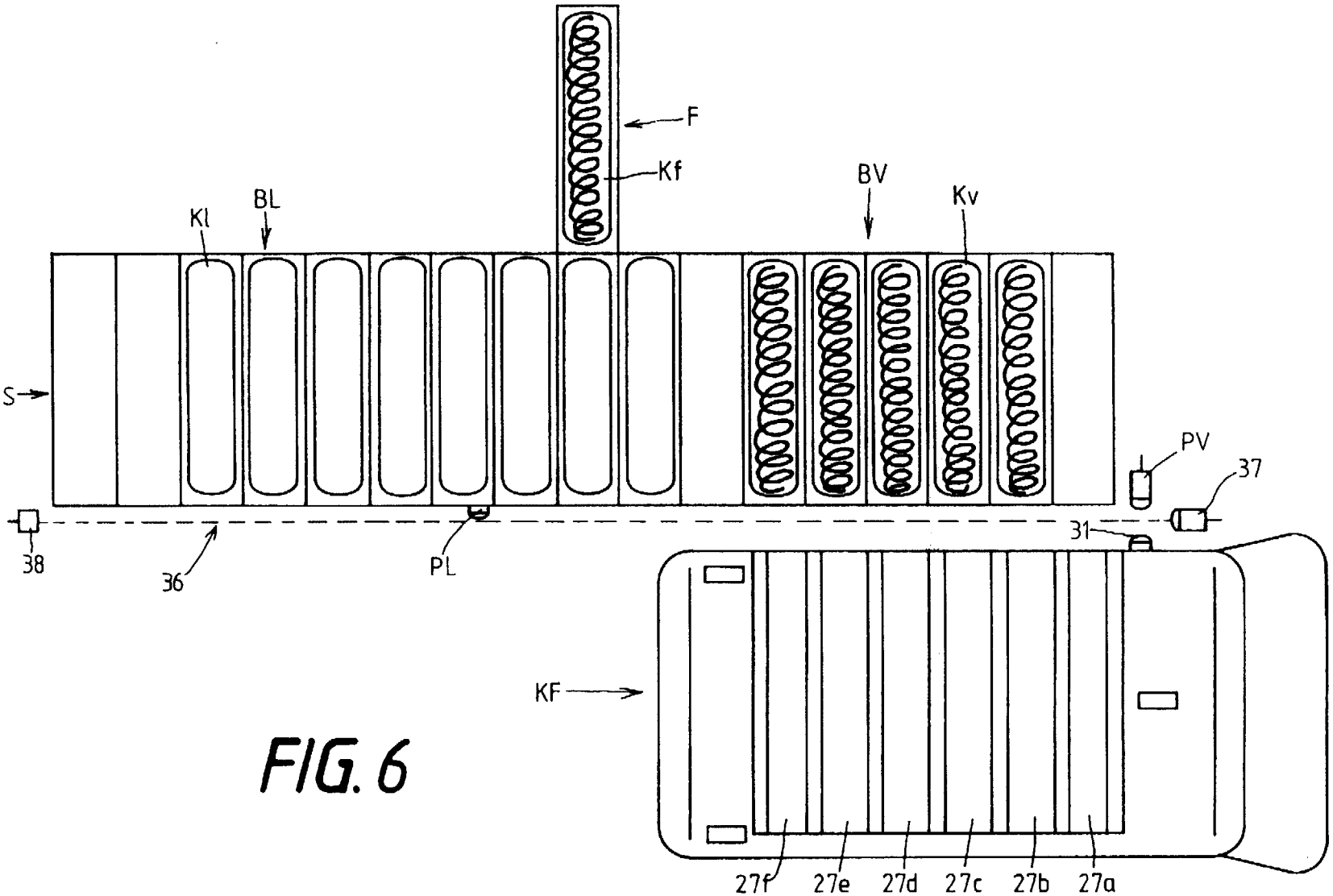
FIGS. 6 and 7 show the subsequent takeover of full cans by the can transport vehicle.

To this end, the can transport vehicle KF moves forward along the track 30 until the sensor 31 on the vehicle KF is located directly opposite the sensor PV associated with the full can storage section BV. In FIG. 6, the can transport vehicle is shown to have taken up such position opposite the full can storage section BV. So that a correct transfer of the full cans Kv to the can transport vehicle KF can take place in accordance with the present invention, all cans in the can storage device S must be moved forward by a sufficient number of the storage spaces BV1–BV8 until the full cans Kv in the full can storage section BV are opposite the parking spaces on the can transport vehicle KF which are intended for occupation with full cans. In this regard, it is necessary in order that a can transport vehicle can perform the first can exchange at a work station of a textile machine that the vehicle must always have an empty parking space on which it can receive an empty can during the first can exchange. For this reason, the first can parking space 27*a* on the can transport vehicle remains empty. Therefore, in the situation illustrated in FIG. 6 of the drawings wherein the five full cans Kv occupy the storage spaces BV2 to BV6, it is necessary to move each of the five full cans Kv forwardly by one storage space so as to occupy the storage spaces BV3 to BV7, whereby the cans are located opposite and can be transferred to the can parking spaces 27*b* to 27*f* on the can transport vehicle. The storage space BV8 is not occupied by a full can since, as explained, the can parking space 27*a* must remain empty. As will be noted, the empty cans at the empty can storage section BL also are moved forwardly each by one storage space to maintain a single can space between the empty cans and the full cans, as more fully explained below.

Figure 7:
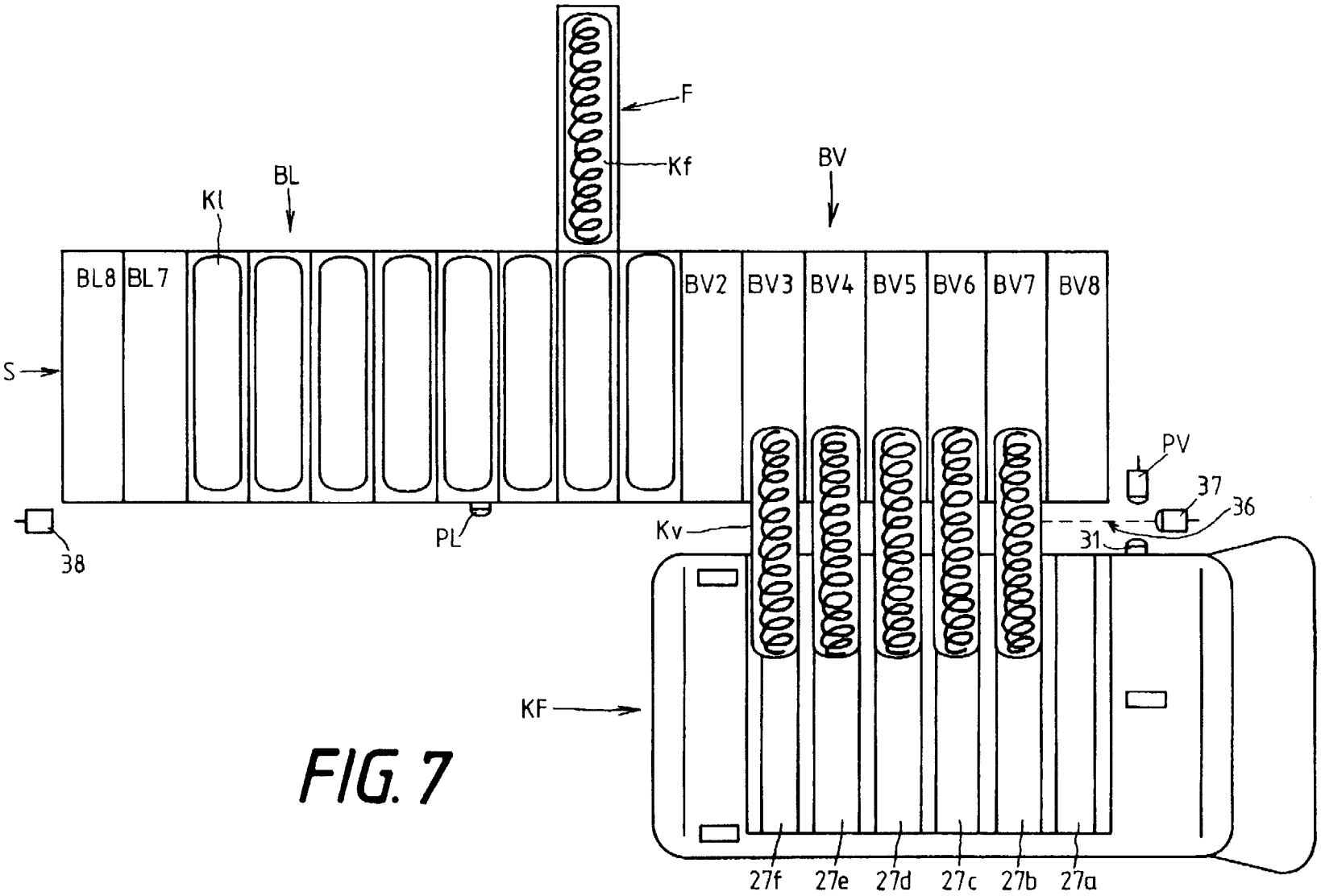
Figure 8:
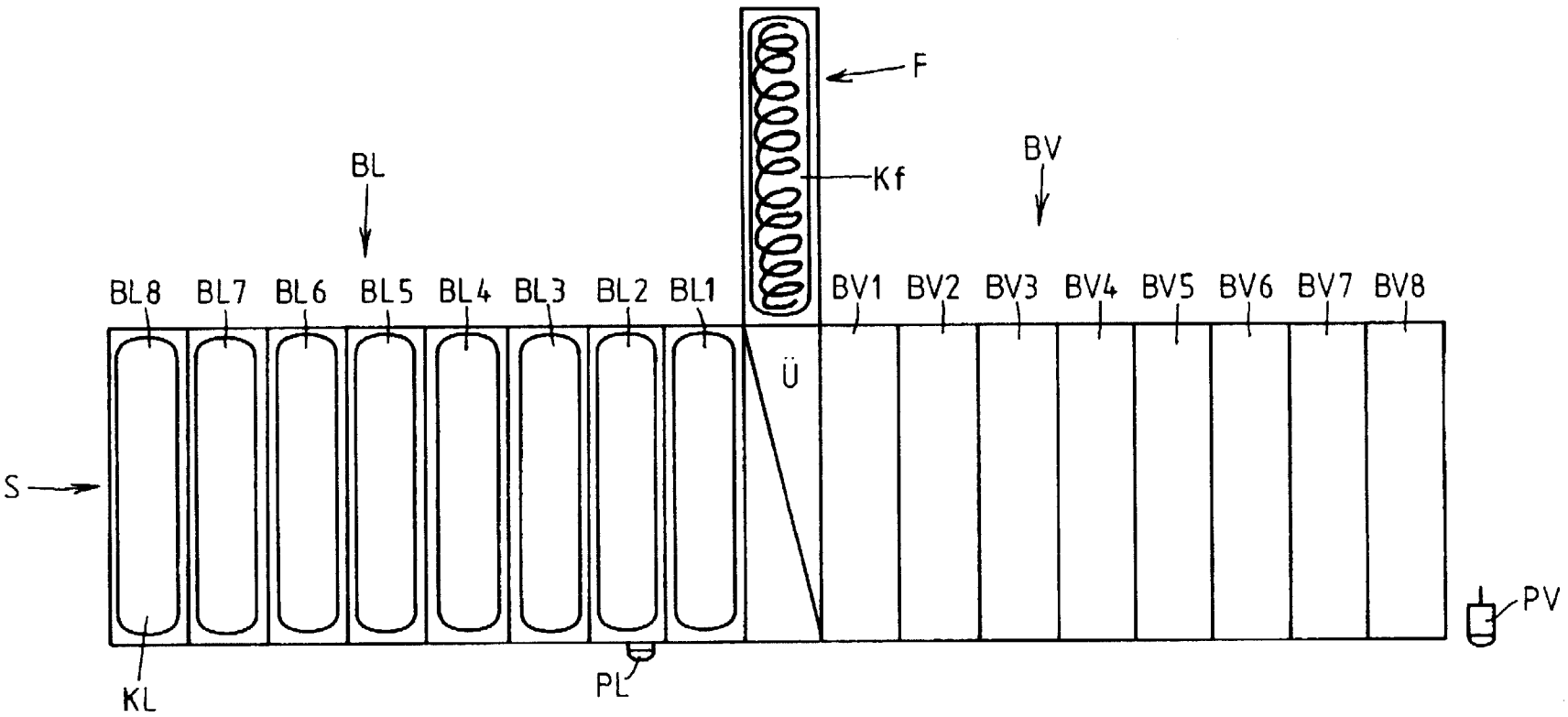
FIG. 8 shows the subsequent return of the remaining cans in the initial position.

In FIG. 7, the five full cans having been moved forwardly as described, the simultaneous transfer of the five full cans Kv to the can transport vehicle KF is shown to be taking place. The correct transfer of the cans is also monitored and controlled in this case by the photoelectric barrier 36 as described above. FIG. 8 depicts the can storage device S after the can transport vehicle has moved away with its load of full cans and the remaining empty cans have been moved back into the base storage positions BL1–BL8.

In accordance with the invention, the single can space between the full cans and the empty cans normally existing at the transfer location Ü must always remain free during any positioning movements of the cans, whether such positioning is to facilitate the transfer of empty cans to the storage device or the transfer of full cans from the storage device. Hence, the return of the empty cans into the base position, i.e. the initial position, can be easily performed simply by moving the cans rearwardly toward the empty can storage section BL until no can is detected at the transfer location Ü by the sensor 34 disposed thereat. In the circumstance illustrated in FIG. 8, the storage space at the transfer location Ü which had not been previously occupied has returned into its initial, or base, position. A comparison of FIG. 5 with FIG. 8 thus reflects that, because of the transfer of the five empty cans from the transport vehicle KF in FIG. 5, all eight storage spaces of the empty can storage section BL of the can storage device S have now been occupied.

Figure 9:
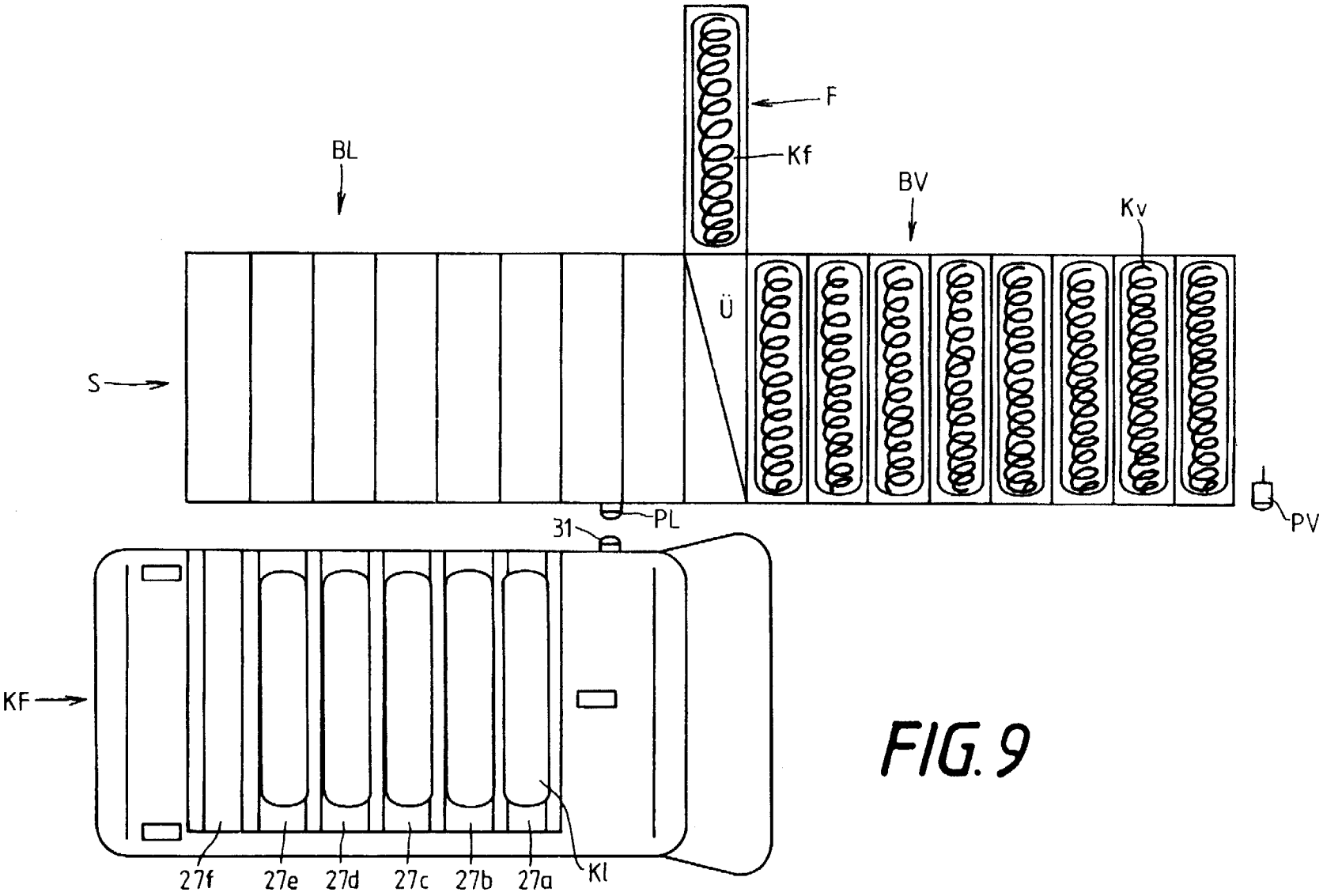
FIGS. 9 and 10 show the transfer of empty cans by means of a can transport vehicle to a can storage device, whose empty can storage section is not occupied and whose full can storage section is completely occupied.
Figure 10:
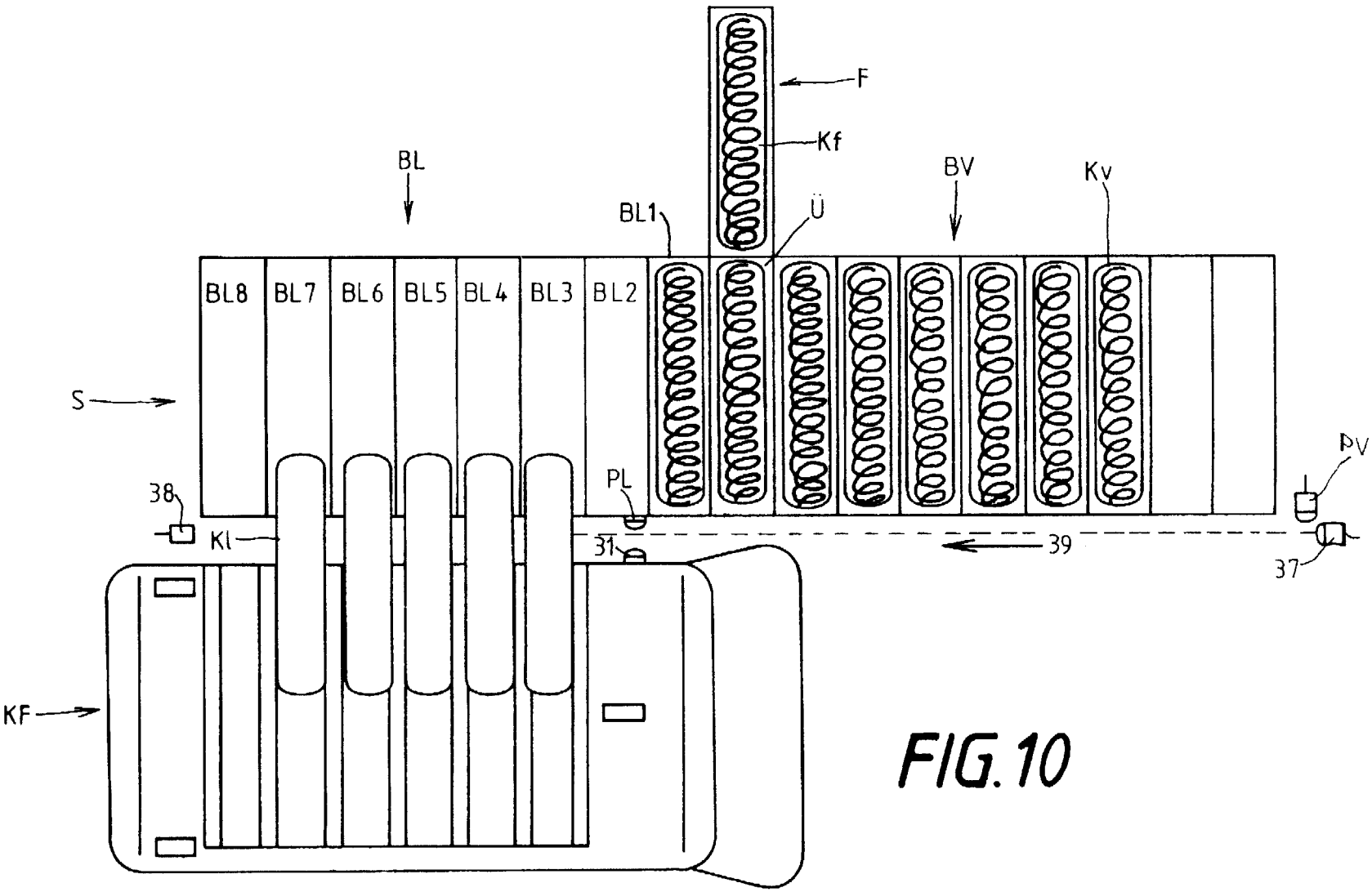

FIGS. 9 and 10 show the transfer of empty cans to a completely free empty can storage section BL, and further illustrate that only a single can parking space may exist as the so-called transfer location Ü between the empty can storage section BL and the full can storage section BV. Only then is it possible to transfer all cans positionally correctly from a can transport vehicle or to transfer filled cans correctly onto a can transport vehicle. Likewise, the process of transferring empty cans to and filled cans from the storage device S and transferring cans to and from the filling station must be designed such that no other gap or space is created, since any such gap cannot be closed once created, and would, in the final analysis, cause a wrong placement of cans.

In FIG. 9, the can transport vehicle KF has been positioned in front of the empty can storage section BL, all storage spaces BL1 to BL8 of which are unoccupied. However, in the situation illustrated, all storage spaces BV1–BV8 of the full can storage section BV are occupied by full cans Kv. Since the can transport vehicle KF can only be positioned according to the sensors 31, PL in the single disposition shown relative to the storage device S for the process of transferring empty cans at the empty can storage section BL, the full cans Kv must be moved rearwardly toward and into the empty can storage section BL sufficiently that, following the transfer of the empty cans, only a space of one can width will remain unoccupied between the transferred empty cans Kl and the full cans By. Thereafter, the belts can be actuated to move the unoccupied space to the transfer location Ü.

FIG. 10 depicts the transfer of the empty cans from the transport vehicle KL to the empty can storage section BL of the can storage device S. As can be seen, the full cans Kv from the full can storage section BV have been moved into the empty can storage section BL in the direction of the arrow 39 by only a sufficient number of storage spaces that a gap of only one storage space will remain between the five empty cans Kl to be transferred and the full cans Kv once the simultaneous can transfer is completed. After the empty can transfer is completed, the control device 32 controls the return movement of the filled cans Kv and the transferred empty cans Kl by monitoring the sensors 34 on the parking spaces to maintain only one parking space unoccupied between the parking spaces which receive empty cans and the parking spaces holding full cans.

Figure 11:
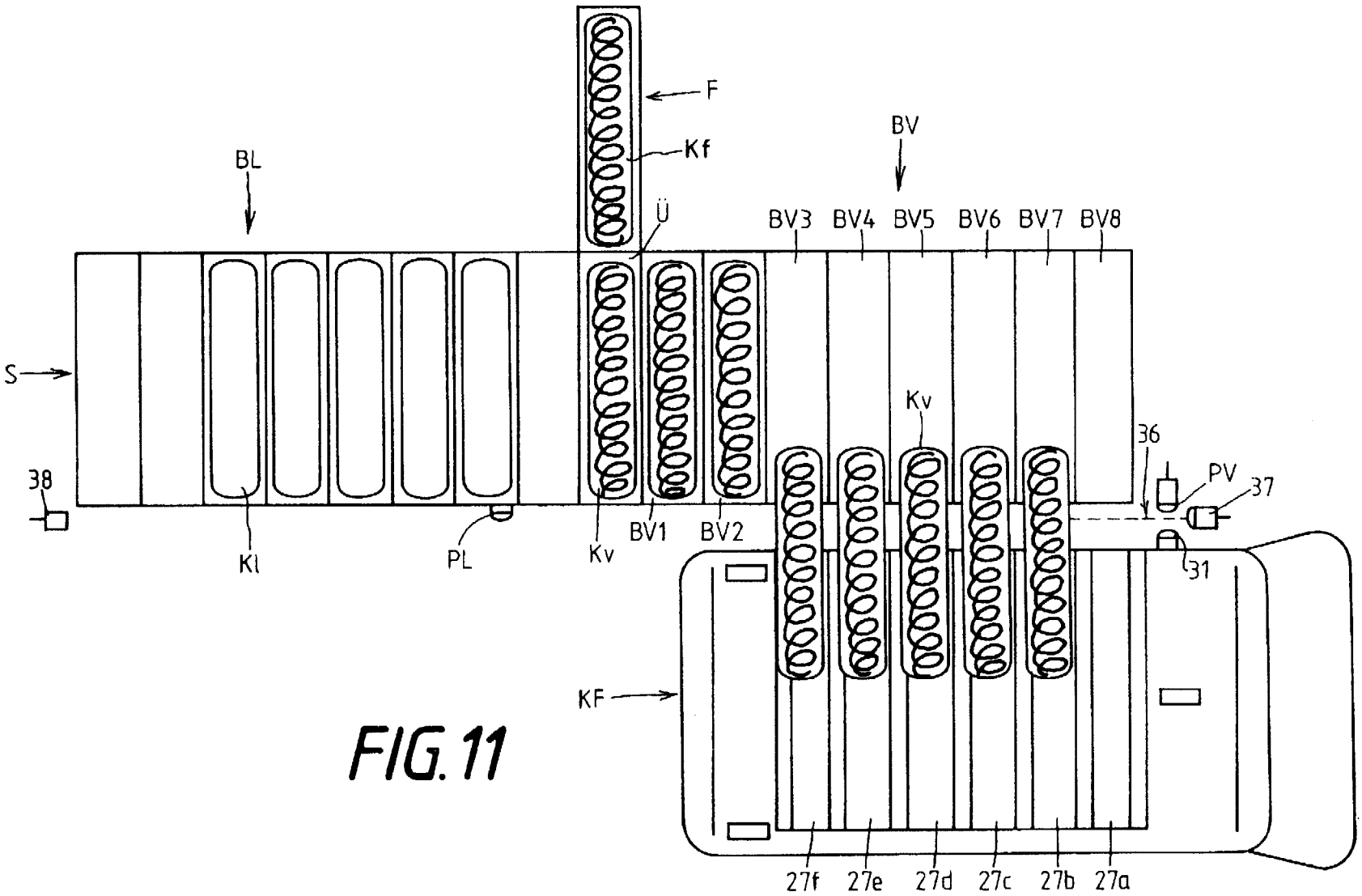
FIG. 11 shows the subsequent takeover of full cans by the can transport vehicle.
Figure 12:
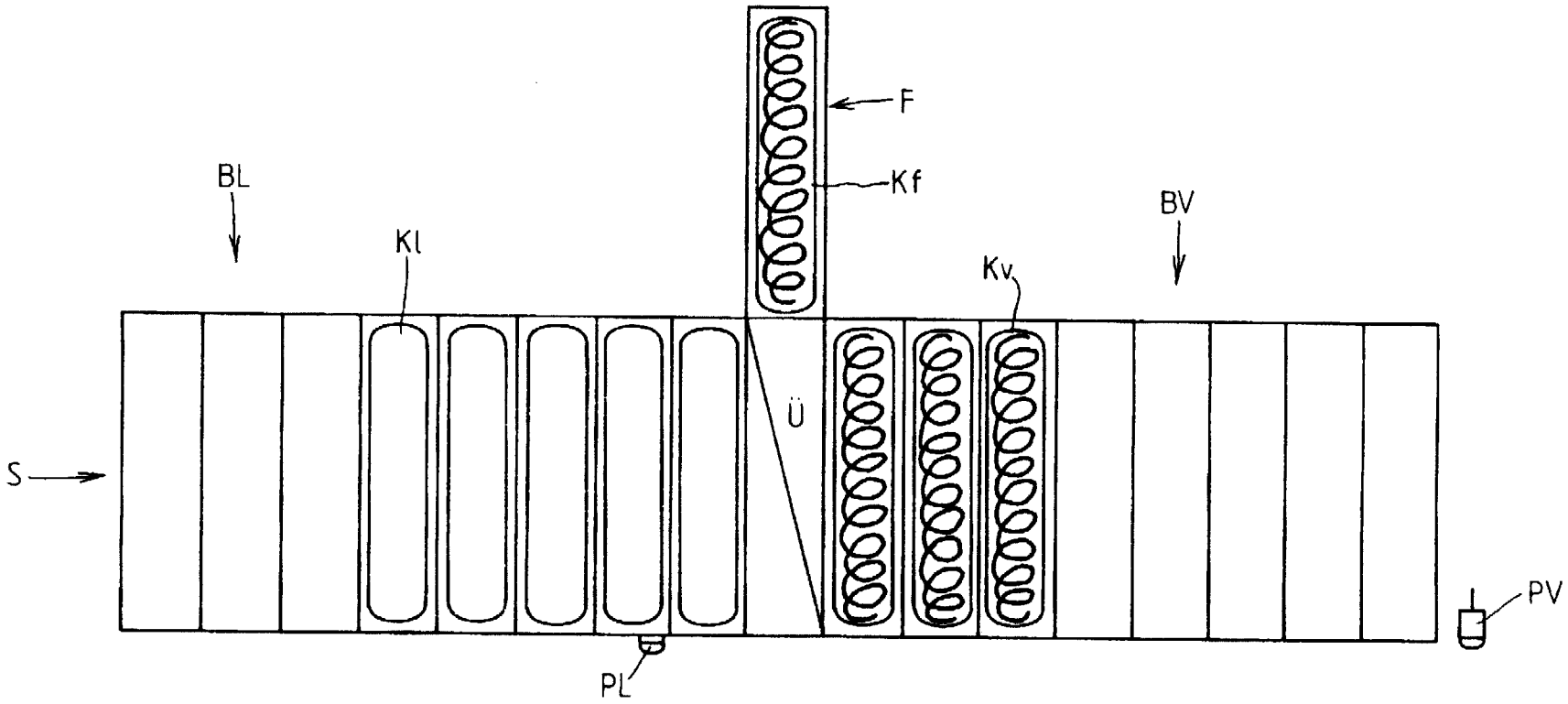
FIG. 12 shows the subsequent return of the remaining cans into the base position.

In the case where the can transport vehicle would not take on full cans, the conveyors are actuated to move the full cans rightwardly to displace the unoccupied space existing at the storage space BL2 to the transfer location Ü. In the case where the can transport vehicle KF is to take on full cans, the vehicle KF once positioned in front of the full can storage section under the control of the positioning sensors 31, PV would not yet be loaded with full cans in the existing circumstance of FIG. 10, even though all eight storage spaces in the full can storage section BV may be occupied by the eight full cans Kv. As can be seen from FIG. 11, the full cans are first moved sufficiently that the final storage space BV8 is unoccupied adjacent the parking space 27*a* of the vehicle KF which, as aforementioned, is required to remain unoccupied for purposes of a subsequent empty can exchange. For this reason, the eight full cans which originally occupied all of the storage spaces BV1–BV8 of the full can storage section BV in FIG. 9, are moved by only one storage space to occupy the transfer location and the first seven full can storage spaces BV1–BV7, leaving the storage space BV8 empty. The cans are now arranged in the area of the full cans BV in such a way that only the parking spaces 27*b* to 27*f* of the can transport vehicle KF can be occupied by the full cans Kv on the storage spaces BV3 to BV7. FIG. 11 depicts this transfer operation underway. FIG. 12 shows the can storage device S following the transfer of the full cans and after the return movement of the cans rightwardly into the base position wherein the previously unoccupied space at BL1 in FIG. 11 has been moved into the transfer location Ü.

Figure 14:
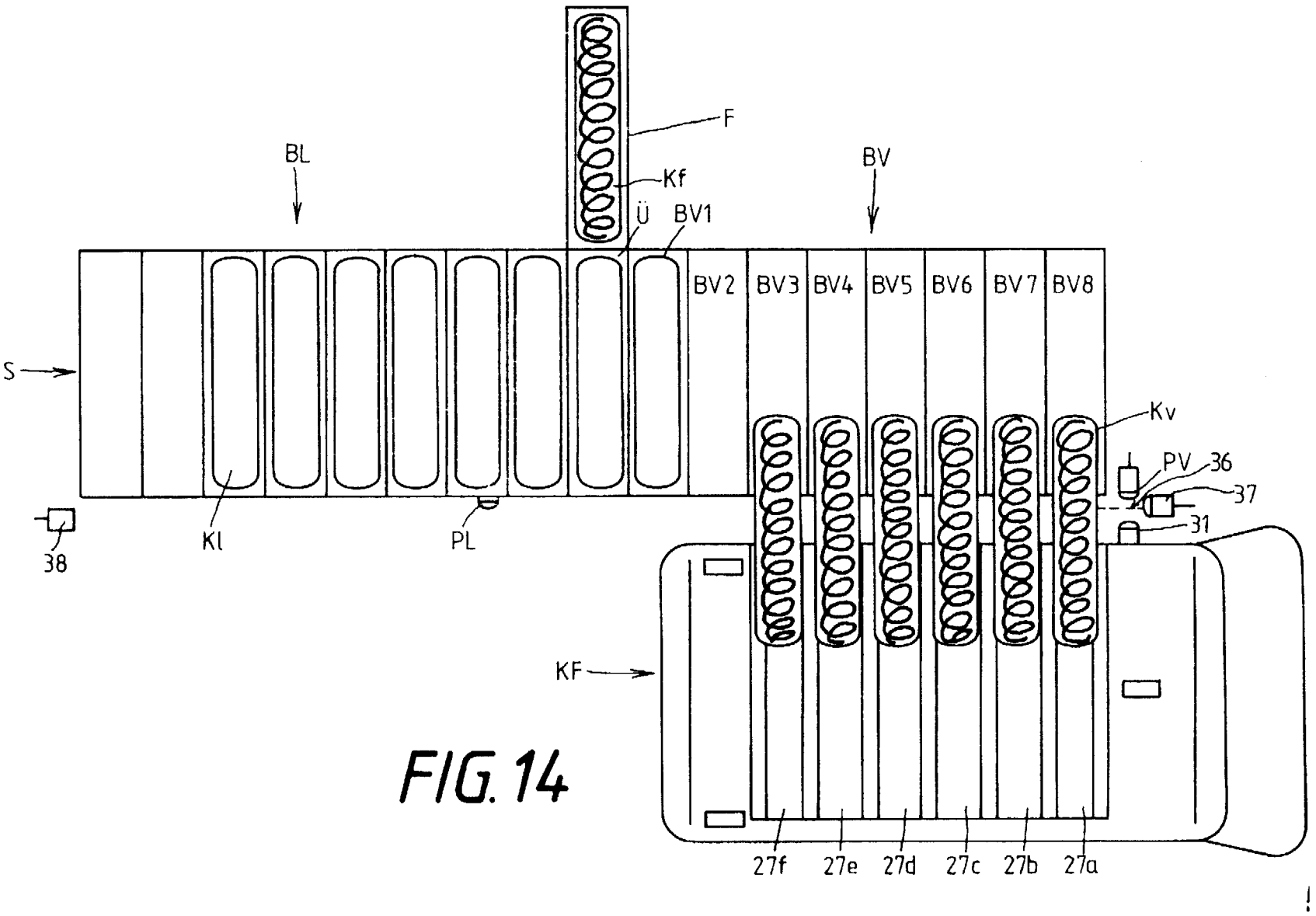
FIG. 14 shows the subsequent transfer of full cans to the can transport vehicle.
Figure 15:
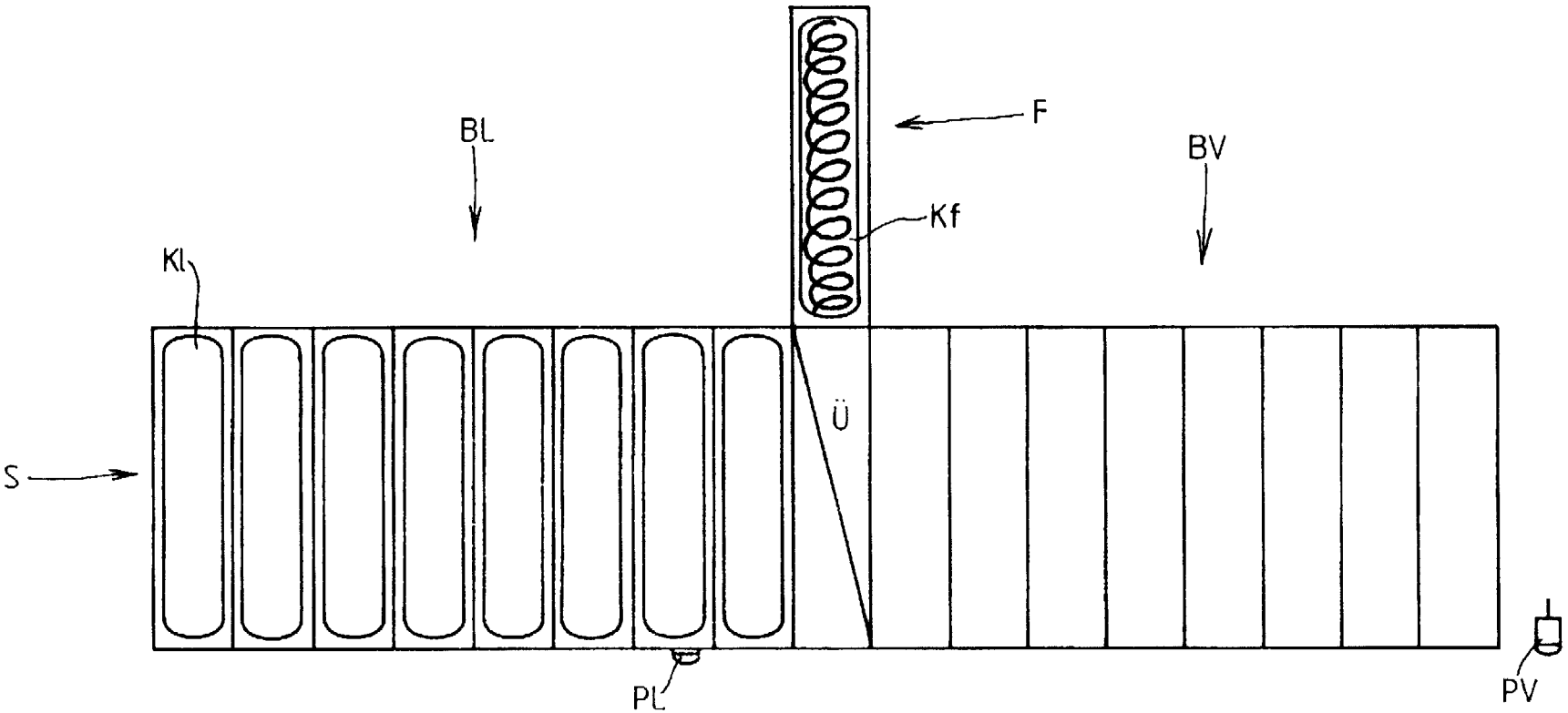
FIG. 15 shows the subsequent return of the remaining cans into the base position.

A so-called block exchange, which is always performed, for example, when a batch change takes place at a machine, is illustrated by means of FIGS. 14 and 15. In such case, since no individual cans are exchanged subsequently at the associated downstream machine because the empty cans are completely exchanged for full cans at the machines, all parking spaces on the can transport vehicle, including the space 27*a*, are occupied by empty cans which are then transferred to the can storage device, and a full can transfer is subsequently performed from the can storage device to occupy all parking spaces on the can transport vehicle with full cans,.

Figure 13:
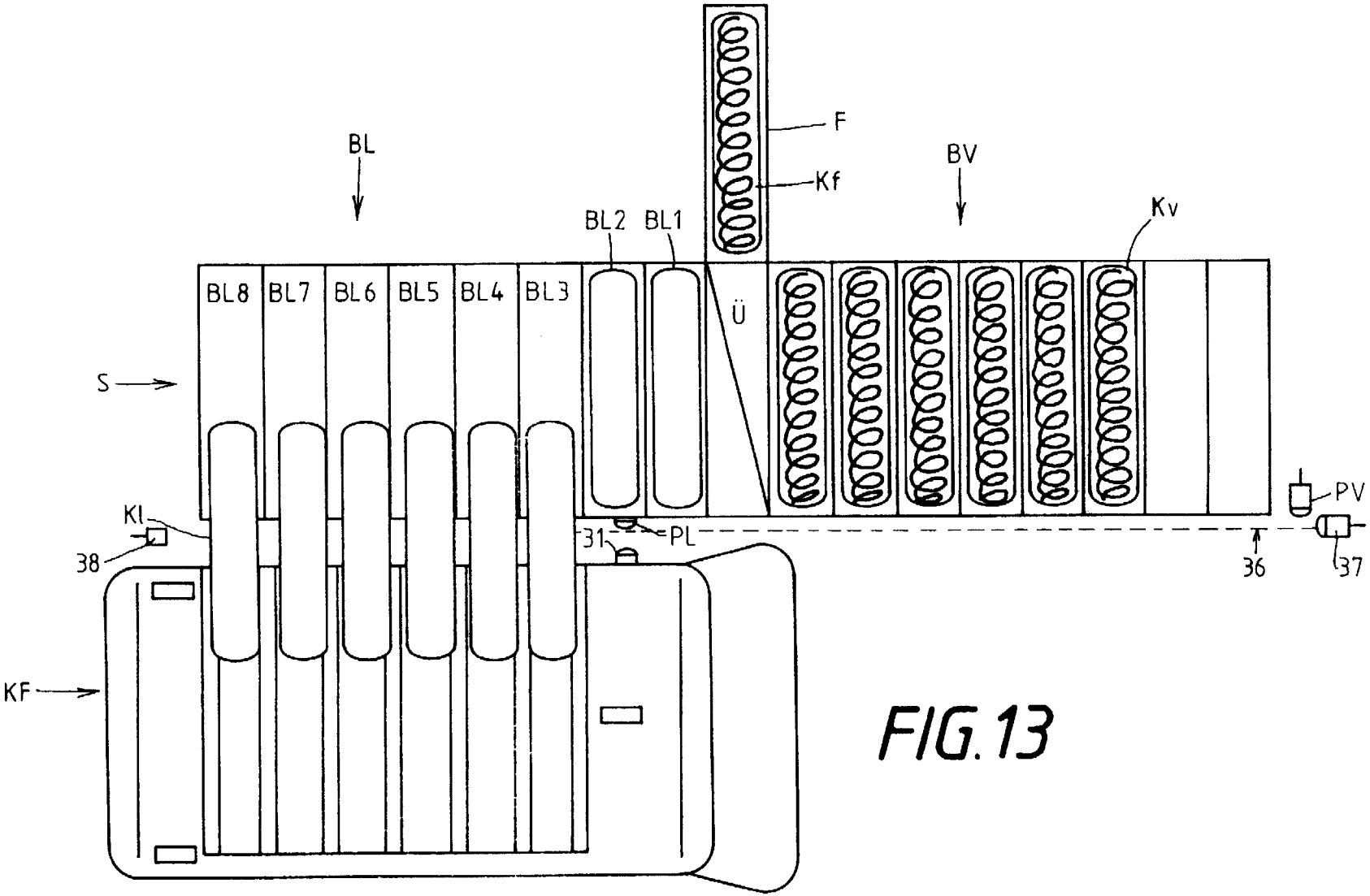
FIG. 13 shows a so-called block exchange, for example during a batch change, the transfer of empty cans by a can transport vehicle.

For this reason the can transport vehicle KF in FIG. 13 carries five empty cans Kl for transfer to the five unoccupied storage spaces in the empty can storage section BL. It is of course a requirement for a block exchange that after the empty cans have been transferred, the can transport vehicle is to loaded to full occupancy of its parking spaces with full cans. In the present situation illustrated in FIG. 14, six full cans Kv are stored by the full can storage section BV and, thus, the can transport vehicle can take on all of them. Since in a block exchange the parking space 27*a* of the can transport vehicle is also occupied by a full can, it is necessary before the transfer of the full cans takes place that the full cans be moved forwardly until all six cans in the full can storage section BV are positioned adjacent the six parking places of the can transport vehicle in its position determined by the sensors 31, PV, i.e., the cans are moved to occupy the storage spaces BV3–BV8 as shown in FIG. 14. However, the eight empty cans stored in the empty can storage section BL are also correspondingly moved forwardly, so that only one storage space remains between the empty cans and the full cans.

After the transfer of the full cans to the can transport vehicle depicted in FIG. 14, the eight empty cans are moved rearwardly until they occupy the eight storage spaces BL1–BL8 whereby the unoccupied space existing in FIG. 14 at the storage space BV2 is moved into the transfer location Ü, as represented in FIG. 15.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for exchanging rectangular sliver cans between a can transport vehicle and a can storage device disposed at a can filling station for filling cans with slivers, wherein the can transport vehicle has a plurality of aligned can parking spaces, the can storage device has a section for storing empty cans in a plurality of aligned empty can spaces and a section for storing full cans in a plurality of aligned full can spaces, and the filling station is disposed between the empty can storage section and the full can storage section, the method comprising the steps of:

positioning the can transport vehicle at the empty can storage section of the can storage device, transferring a plurality of empty cans substantially simultaneously from the can transport vehicle to the empty can storage section, moving empty cans from the empty can storage section to the filling station to be filled with sliver, moving the filled cans from the filling station to the full can storage section, positioning the can transport vehicle at the full can storage section of the can storage device, and transferring a plurality of full cans substantially simultaneously from the full can storage section to the can transport vehicle positioned at the can storage device, wherein the transferring of empty cans to the empty can storage section includes determining the arrangement of empty cans already stored in the empty can spaces of the empty can storage section and moving said arrangement of empty cans by a sufficient number of empty can spaces that the empty can spaces located opposite the parking spaces having empty cans on the can transport vehicle to be transferred are unoccupied, and subsequent to the transferring of empty cans to the empty can storage section, moving said already-stored arrangement of empty cans and the empty cans transferred from the can transport vehicle to occupy the empty can spaces of the empty can storage section most closely adjacent the filling station, and wherein the transferring of full cans from the full can storage section includes determining the arrangement of full cans already stored in the full can spaces of the full can storage section and moving said arrangement of full cans by a sufficient number of full can spaces that a forwardmost one of the full can spaces occupied by a full can is located opposite a forwardmost occupiable can space on the can transport vehicle, and subsequent to the transferring of full cans to the can transport vehicle, moving any full cans remaining at the full can storage section to occupy the full can spaces most closely adjacent the filling station.

2. The method in accordance with claim 1, wherein the empty cans from the can transport vehicle are transferred to the empty can spaces in the empty can storage section immediately following the already-stored empty cans.

3. Apparatus for storing rectangular sliver cans in association with a can filling station for filling cans with sliver and including means for exchanging sliver cans with a can transport vehicle, wherein the can transport vehicle has a plurality of aligned can parking spaces, the can storage apparatus has a section for storing empty cans in a plurality of aligned empty can spaces and a section for storing full cans in a plurality of aligned full can spaces, the filling station is disposed between the empty can storage section and the full can storage section, and a can transfer space is disposed between the respective can spaces of the empty can storage section and the full can storage section for transfer of individual cans to and from the filling station, the apparatus comprising:

means for positioning the can transport vehicle at the empty can storage section of the can storage device, means for substantially simultaneously transferring a plurality of empty cans from the can transport vehicle to the empty can storage section, means for moving empty cans from the empty can storage section to the transfer space for transfer to the filling station to be filled with sliver, means for moving the cans filled at the filling station from the transfer space to the full can storage section, means for positioning the can transport vehicle at the full can storage section of the can storage device, and means for substantially simultaneously transferring a plurality of full cans from the full can storage section to the can transport vehicle positioned at the can storage device, wherein the means for transferring of empty cans to the empty can storage section includes means for determining the arrangement of empty cans already stored in the empty can spaces of the empty can storage section and for controlling the means for moving empty cans for moving said arrangement of empty cans by a sufficient number of empty can spaces that the empty can spaces located opposite the parking spaces having empty cans on the can transport vehicle to be transferred are unoccupied, and subsequent to the transferring of empty cans to the empty can storage section, for moving said already-stored arrangement of empty cans and the empty cans transferred from the can transport vehicle to occupy the empty can spaces of the empty can storage section most closely adjacent the filling station, and wherein the means for transferring of full cans from the full can storage section includes means for determining the arrangement of full cans already stored in the full can spaces of the full can storage section and for controlling the means for moving filled cans for moving said arrangement of full cans by a sufficient number of full can spaces that a forwardmost one of the full can spaces occupied by a full can is located opposite a forwardmost occupiable can space on the can transport vehicle, and subsequent to the transferring of full cans to the can transport vehicle, for moving any full cans remaining at the full can storage section to occupy the full can spaces most closely adjacent the filling station.

4. Apparatus for storing rectangular sliver cans in association with a can filling station according to claim 3, wherein the means for moving empty cans and the means for moving filled cans include can carrier elements spaced from one another by a distance of one can width, a can moving means with spaced can carrier elements for supporting a single can is provided at the transfer space to the filling station, means for selectively coupling the can moving means at the transfer space alternatingly or mutually with the means for moving empty cans and with the means for moving filled cans, and wherein the means for moving empty cans includes a controllable drive means for selectively displacing the empty can storage section by a predeterminable distance and the means for moving filled cans has an independent controllable drive means for selectively displacing the full can storage section by a predeterminable distance.

5. Apparatus for storing rectangular sliver cans in association with a can filling station according to claim 3, wherein both the empty can storage section and the full can storage section respectively have a larger number of can spaces than the parking spaces of the can transport vehicle.

6. Apparatus for storing rectangular sliver cans in association with a can filling station according to claim 3, wherein the means for positioning the can transport vehicle at the empty can storage section defines a first fixed position for the can transport vehicle, and the means for positioning the can transport vehicle at the full can storage section defines a second fixed position for the can transport vehicle following the first fixed position in the traveling direction of the can transport vehicle.

7. Apparatus for storing rectangular sliver cans in association with a can filling station according to claim 4, wherein the controllable drive means for the empty can storage section and the controllable drive means for the full can storage section are operable to leave the transfer space unoccupied after both a transfer of empty cans to the empty can storage section and a transfer of full cans from the full can storage section.

8. Apparatus for storing rectangular sliver cans in association with a can filling station according to claim 3, wherein each can space in the can storage device includes a sensor for detecting occupancy of the respective space by a can.

* * * * *